US009577366B2

(12) United States Patent
Ishii

(10) Patent No.: US 9,577,366 B2
(45) Date of Patent: Feb. 21, 2017

(54) WATERPROOF CONNECTOR HAVING AN ELASTIC SEAL MEMBER WITH THE ENGAGED PORTION

(71) Applicant: Hirose Electric Co., Ltd., Tokyo (JP)

(72) Inventor: Kentaro Ishii, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/729,123

(22) Filed: Jun. 3, 2015

(65) Prior Publication Data

US 2015/0364855 A1 Dec. 17, 2015

(30) Foreign Application Priority Data

Jun. 17, 2014 (JP) ..... 2014-124315

(51) Int. Cl.
*H01R 9/05* (2006.01)
*H01R 13/52* (2006.01)

(52) U.S. Cl.
CPC ..... *H01R 13/5202* (2013.01)

(58) Field of Classification Search
CPC . H01R 13/52; H01R 13/5202; H01R 13/5205; H01R 13/5219; H01R 13/5221; H01R 33/965
USPC ..... 439/271, 587, 273
See application file for complete search history.

(56) References Cited

U.S. PATENT DOCUMENTS 5,114,359 A * 5/1992 Chishima ..... H01R 13/5221 439/271
5,158,391 A * 10/1992 Fujitani ..... H01R 13/5202 277/615
8,317,530 B2 * 11/2012 Sawairi ..... H01R 13/5219 439/271

FOREIGN PATENT DOCUMENTS

JP 4346495 B 7/2009

* cited by examiner

*Primary Examiner* — Hae Moon Hyeon
(74) *Attorney, Agent, or Firm* — Kubotera & Associates, LLC

(57) ABSTRACT

A waterproof connector includes a housing and an elastic seal member. The housing includes a hollow portion for accommodating a mating connector. The elastic seal member is placed in the housing. The elastic seal member includes a main body portion and an engaged portion extending from the main body portion. An extending end portion of the engaged portion includes a protruding portion, and the protruding portion protrudes outwardly. The extending end portion has a width in a protruding direction of the protruding portion greater than a width of an entrance of an installation portion in the protruding direction where the extending end portion is to be accommodated.

9 Claims, 17 Drawing Sheets

WATERPROOF CONNECTOR HAVING AN ELASTIC SEAL MEMBER WITH THE ENGAGED PORTION

BACKGROUND OF THE INVENTION AND RELATED ART STATEMENT

The present invention relates to a waterproof connector. More particularly, the invention relates to a waterproof connector including a housing and an elastic seal member. In the waterproof connector, the housing includes a hollow portion for accommodating at least a part of a mating connector, and the elastic seal member is placed at a specific location in the housing after the elastic seal member is guided along the hollow portion of the housing in a specific direction.

Patent Reference has disclosed a conventional waterproof connector. FIG. 19 is a plan view showing the conventional waterproof connector having an elastic seal member (a packing) 101 according to Patent Reference. FIG. 20 is a sectional view showing the conventional waterproof connector when the elastic seal member 101 is attached to a housing 102 of the conventional waterproof connector according to Patent Reference.

Patent Reference: Japanese Patent Publication No. 4,346,495

In the conventional waterproof connector disclosed in Patent Reference, the elastic seal member 101 is formed in a substantially short cylindrical shape as a whole. The elastic seal member 101 has an opening portion 113 at a center thereof. Further, the elastic seal member 101 has a pressing surface 111 formed in an accordion shape to be pressed and contacted with an inner surface of the housing 102 along a longitudinal direction thereof. Further, engaged portions (engaged pieces) 112 are formed to face each other near a lower end portion of the pressing surface 111, so that the engaged portions 112 are capable of engaging with engaging pieces (engaging holes) 121 formed in the housing 102.

In the conventional waterproof connector disclosed in Patent Reference, when the elastic seal member 101 is fitted into the housing 102 with a specific tool, the elastic seal member 101 is placed at a specific location in a hollow portion 114 of the housing 102. The engaged portions 112 are formed in a thin plate shape and extend in a direction away from the opening portion 113. When the elastic seal member 101 is attached to the housing 102, the engaged portions 112 are pushed into the engaging holes 121 with an external force while rotating around the pressing surface 111.

As described above, in the conventional waterproof connector disclosed in Patent Reference, the elastic seal member 101 is formed in a thin plate shape. Accordingly, after the engaged portions 112 of the elastic seal member 101 are pushed into the engaging holes 121 formed in the housing 102, distal end portions of the engaged portions 112 are exposed from an outer surface of the housing 102. Accordingly, if an operator accidentally pushes the distal end portions of the engaged portions 112, the engaged portions 112 may be easily come off from the engaging holes 121 formed in the housing 102.

In view of the problems of the conventional waterproof connector described above, an object of the present invention is to provide a waterproof connector capable of solving the problems. In the waterproof connector, a housing thereof includes an engaged portion. Accordingly when an elastic seal member is guided in a specific direction along a hollow portion of the housing, it is possible to easily engage the elastic seal member with the engaged portion at a specific location in the hollow portion of the housing.

Further objects and advantages of the present invention will be apparent from the following description of the present invention.

SUMMARY OF THE PRESENT INVENTION

In order to attain the objects described above, according to a first aspect of the present invention, a waterproof connector includes a housing and an elastic seal member. The housing includes a hollow portion for accommodating at least a part of a mating connector. The elastic seal member is placed at a specific location of the housing after the elastic seal member is guide in a specific guiding direction along the hollow portion of the housing.

According to the first aspect of the present invention, the elastic seal member includes a main body portion having a ring shape and being arranged on an inner surface of the hollow portion. The elastic seal member further includes an engaged portion extending from the main body portion in a direction that the engaged portion is away from the main body portion. An extending end portion of the engaged portion includes a protruding portion on a rear end side thereof in the specific guiding direction, and the protruding portion protrudes outwardly farther than a distal end side of the engaged portion.

According to the first aspect of the present invention, the extending end portion has a width in a protruding direction of the protruding portion greater than a width of an entrance of an installation portion in the protruding direction where the extending end portion is to be accommodated. When the engaged portion is guided in the specific guiding direction, the engaged portion abuts against the entrance of the installation portion, so that the protruding portion is deformed. Accordingly, it is possible to pass the protruding portion through the entrance of the installation portion.

According to the first aspect of the present invention, with the configuration described above, when the elastic seal member is simply guided in the specific guiding direction along the hollow portion of the housing, it is possible to easily engage the elastic seal member at the installation location of the waterproof connector with the engaged portion.

According to a second aspect of the present invention, in the waterproof connector in the first aspect, the engaged portion may further include a deformation portion at the distal end side thereof. The deformation portion is configured to be deformed when the engaged portion abuts against a part of the housing in the specific guiding direction, so that the elastic seal member is capable of moving in the specific guiding direction.

According to a third aspect of the present invention, in the waterproof connector in the second aspect, when the elastic seal member is moved in the specific guiding direction, the deformation portion may be configured to deform the protruding portion when the engaged portion abuts against the entrance of the installation portion, so that the protruding portion is capable of passing through the entrance of the installation portion. After the protruding portion passes through the entrance of the installation portion, the protruding portion is returned to a shape before the protruding portion is deformed. Accordingly, the protruding portion is capable of abutting against other part of the housing situated at a location on the opposite side of the part of the housing. With the configuration described above, it is possible to securely engage the elastic seal member at the specific location of the waterproof connector.

According to a fourth aspect of the present invention, in the waterproof connector in the first aspect, the hollow portion may include a guide groove extending along the specific guiding direction. The elastic seal member may further include a connecting portion connecting the extending end portion of the engaged portion and the main body portion. Accordingly, the elastic seal member is capable of being guided through the guide groove while the connecting portion is fitted in the guide groove. With the configuration described above, it is possible to easily guide the elastic seal member to the specific location of the housing with the guide groove. Further, it is possible to securely fix the elastic seal member at the specific location.

According to a fifth aspect of the present invention, in the waterproof connector in the fourth aspect, the guide groove may have a width in the protruding direction gradually decreasing along the specific guiding direction. With the configuration described above, the guide groove is capable of gradually tightening the connecting portion of the elastic seal member. Further, it is possible to securely fix the elastic seal member at the specific location.

According to a sixth aspect of the present invention, in the waterproof connector in the fourth aspect, the connecting portion of the elastic seal member may have a width in the protruding direction smaller than a width of the guide groove in the protruding direction at an entrance thereof. Further, the connecting portion of the elastic seal member may have a width in the protruding direction equal to or smaller than a width of the guide groove in the protruding direction near the specific location.

According to the sixth aspect of the present invention, when the connecting portion has such a width as described above, it is possible to smoothly insert the elastic seal member through the entrance of the guide groove, and to securely fix the elastic seal member at the specific location. Further, when the connecting portion has such a width as described above, the protruding portion abuts against an outer surface of the housing constituting the guide groove at a backside surface thereof. Accordingly, it is possible to prevent the elastic seal member from bending into the hollow portion of the housing.

According to a seventh aspect of the present invention, in the waterproof connector in the first aspect, the extending end portion of the engaged portion may be formed in a substantially reverse trapezoid shape in a front view thereof.

According to an eighth aspect of the present invention, in the waterproof connector in the second aspect, the deformation portion may include a pair of mountain portions protruding toward the specific guiding direction and being separated with a recessed portion having a reverse U-character shape. With the configuration described above, when the elastic seal member abuts against the part of the housing in the specific guiding direction, the pair of mountain portions is deformed in a direction away from each other upon receiving an impact.

According to a ninth aspect of the present invention, in the waterproof connector in the first aspect, the main body portion of the elastic seal member may be formed in a substantially rectangular shape in a front view thereof, and the engaged portion may be formed at a center of each side of the substantially rectangular shape. When the main body portion is formed in the substantially rectangular shape, it is possible to easily set an orientation of the elastic seal member relative to the housing.

According to a tenth aspect of the present invention, in the waterproof connector in the ninth aspect, the engaged portion may be formed at three sides of the substantially rectangular shape. When the engaged portion is formed at three sides of the substantially rectangular shape, as opposed to a configuration in which the engaged portion is formed at only one side or two sides of the substantially rectangular shape, it is possible to fix the elastic seal member to the housing in a more stable state. Further, as opposed to a configuration in which the engaged portion is formed at four sides of the substantially rectangular shape, it is possible to prevent a size of the waterproof connector from being excessively large.

According to an eleventh aspect of the present invention, a waterproof connector device may include the waterproof connector in the first aspect and the mating connector connected to the waterproof connector.

As described above, in the waterproof connector according to the present invention, when the elastic seal member is simply guided in the specific guiding direction along the hollow portion of the housing, it is possible to easily engage the elastic seal member at the specific installation location of the waterproof connector with the engaged portion.

DETAILED DESCRIPTION OF THE PREFERRED EMBODIMENTS

Hereunder, embodiments of the present invention will be described with reference to the accompanying drawings.

Figure 1:
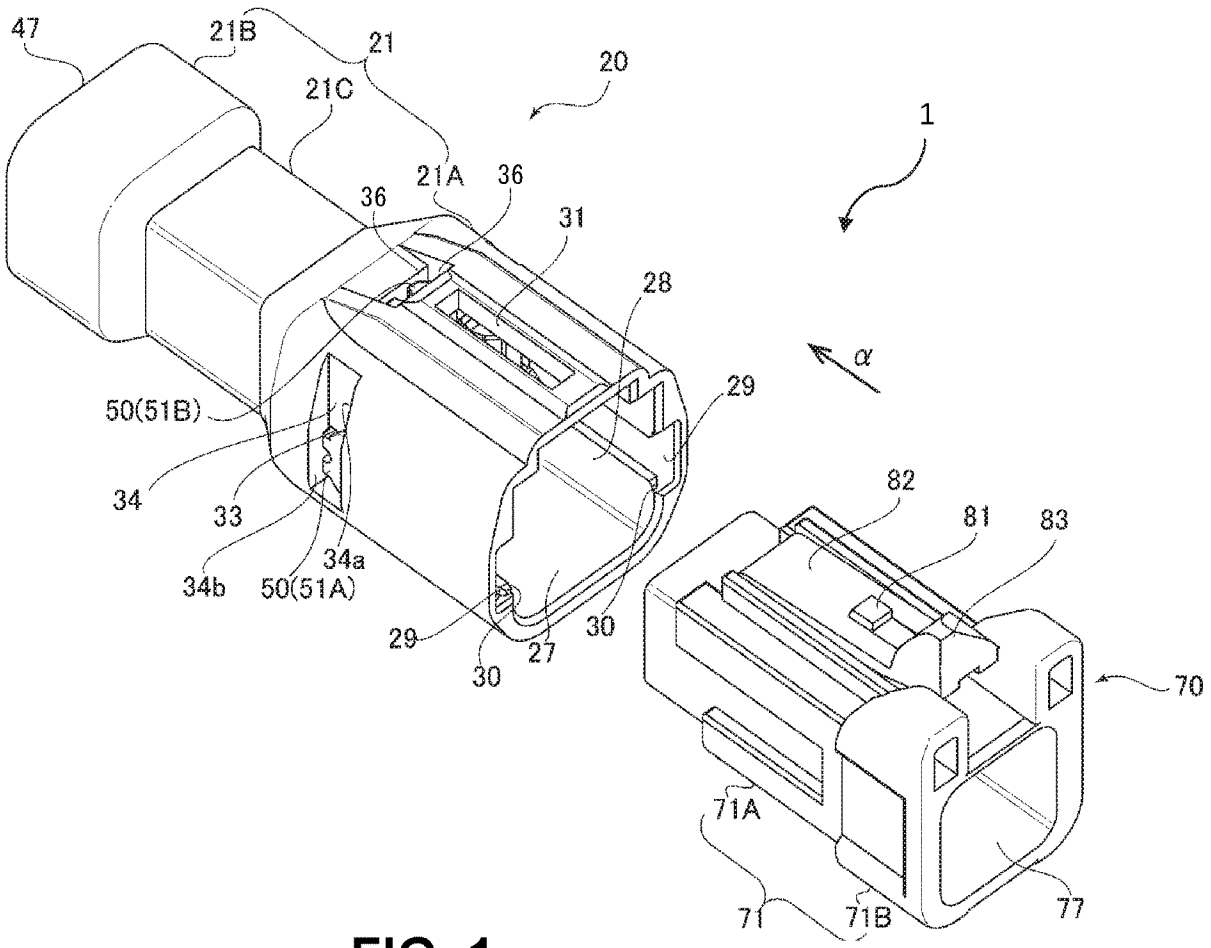
FIG. 1 is a perspective view showing a waterproof connector device viewed from an upper surface thereof before a receptacle connector thereof is connected to a plug connector thereof according to an embodiment of the present invention.
Figure 2:
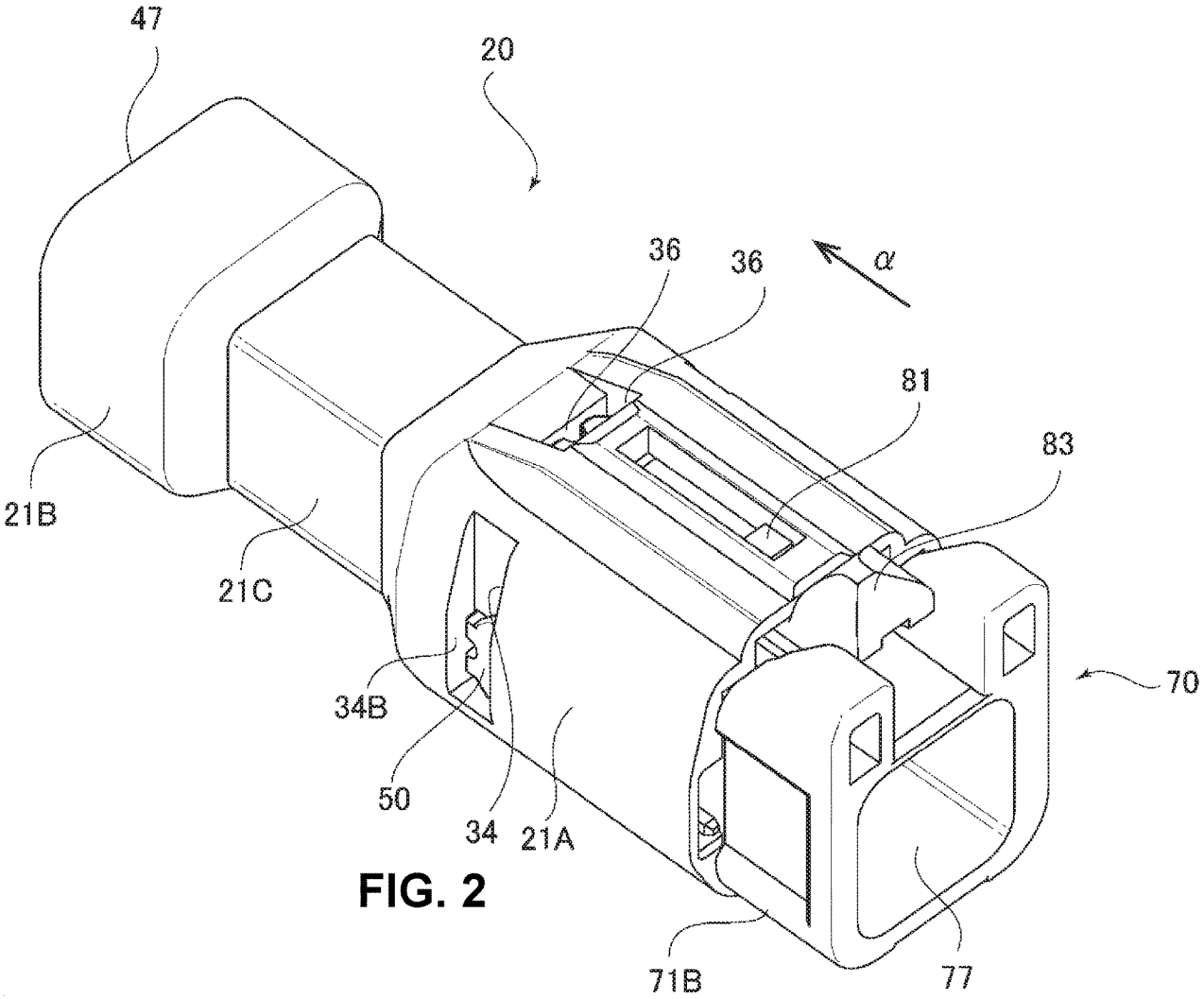
FIG. 2 is a perspective view showing the waterproof connector device after the receptacle connector thereof is connected to the plug connector thereof according to the embodiment of the present invention.

FIG. 1 is a perspective view showing a waterproof connector device 1 viewed from an upper surface thereof before a receptacle connector (a waterproof connector) 20 thereof is connected to a plug connector (a mating connector) 70 thereof according to an embodiment of the present invention. FIG. 2 is a perspective view showing the waterproof connector device 1 after the receptacle connector 20 thereof is connected to the plug connector 70 thereof according to the embodiment of the present invention.

As shown in FIGS. 1 and 2, the waterproof connector device 1 is formed of a pair of the receptacle connector 20 and the plug connector 70 capable of being connected to each other along a specific direction (an arrow direction $\alpha$). It should be noted that both the receptacle connector 20 and the plug connector 70 are formed in a symmetrical shape in a left-to-right direction, and may be formed in a non-symmetrical shape.

In the embodiment, the receptacle connector 20 includes a hollow portion 27 for accommodating a part of the plug connector 70. A lock hole 31 is formed in an upper surface of the receptacle connector 20. Further, an elastic engaging piece 82 is formed on an upper surface of the plug connector 70, and a lock protruding portion 81 is formed on the elastic engaging piece 82. When a part of the plug connector 70 is inserted into the hollow portion 27, the plug connector 70 can be fitted to the receptacle connector 20. When the plug connector 70 is fitted to the receptacle connector 20, the lock protruding portion 81 is fitted into and penetrated through the lock hole 31 from inside toward outside, so that the receptacle connector 20 is tightly connected to the plug connector 70. Further, an operation portion 83 is disposed adjacent to the lock protruding portion 81. Accordingly, when the operation portion 83 is pushed down toward the plug connector 70, it is possible to disengage the lock protruding portion 81 from the lock hole 31.

In the embodiment, when the waterproof connector device 1 is used, a plurality of cables (not shown) is connected to each of the receptacle connector 20 and the plug connector 70. More specifically, the receptacle connector 20 includes a drawing outlet 47 on an opposite side thereof connected to the plug connector 70, and the plug connector 70 includes a drawing outlet 77 on an opposite side thereof connected to the receptacle connector 20. When a plurality of cables is connected to the receptacle connector 20, the cables are drawn out through the drawing outlet 47. Similarly, when a plurality of cables is connected to the plug connector 70, the cables are drawn out through the drawing outlet 77. Further, each of the receptacle connector 20 and the plug connector 70 includes a plurality of contacts (not shown) disposed therein corresponding to the cables, so that the cables are capable of being electrically connected to each other through the contacts.

More specifically, the plug connector 70 includes a housing 71 and a plurality of contacts supported with the housing 71. The housing 71 is formed in an elongated shape member having a substantially rectangular sectional shape. Further, the housing 71 includes an insertion portion 71A with a small size to be inserted into the hollow portion 27 of the receptacle connector 20, and a cable drawing portion 71B with a large size. The insertion portion 71A is provided with the elastic engaging piece 82 extending toward the cable drawing portion 71B. When the receptacle connector 20 is connected to the plug connector 70, the elastic engaging piece 82 engages with the receptacle connector 20. A lock protruding portion 81 is disposed on the elastic engaging piece 82 of the insertion portion 71A, and an operation portion 83 is disposed adjacent to the lock protruding portion 81 near the cable drawing portion 71B for operating the elastic engaging piece 82.

In the embodiment, the receptacle connector 20 includes a housing 21, a plurality of contacts supported with the housing 21, and an elastic seal member 50. Similar to the housing 71 of the plug connector 70, the housing 21 is formed in an elongated shape member having a substantially rectangular sectional shape. Further, the housing 21 includes a base portion 21C with a small size disposed at a substantially center thereof, an accommodation portion 21A with a large size disposed on one side of the base portion 21C, and a cable drawing portion 21B having a hollow shape and disposed on the other side of the base portion 21C. The accommodation portion 21A includes a hollow portion 27 for accommodating the insertion portion 71A of the plug connector 70 and the elastic seal member 50, and a lock hole 31 for engaging with the plug connector 70.

In the embodiment, similar to the plug connector 70, the elastic seal member 50 is guided along the hollow portion 27 formed in the accommodating portion 21A in the direction α that is the same as the fitting direction between the receptacle connector 20 and the plug connector 70. After the elastic seal member 50 is guided along the hollow portion 27, the elastic seal member 50 is placed at a specific location in the housing 21.

The housing 21 includes recessed portions 28 and 29 formed in the hollow portion 27 at locations corresponding to extending portions or engaged portions 51A and 51B of the elastic seal member 50.

Figure 3:
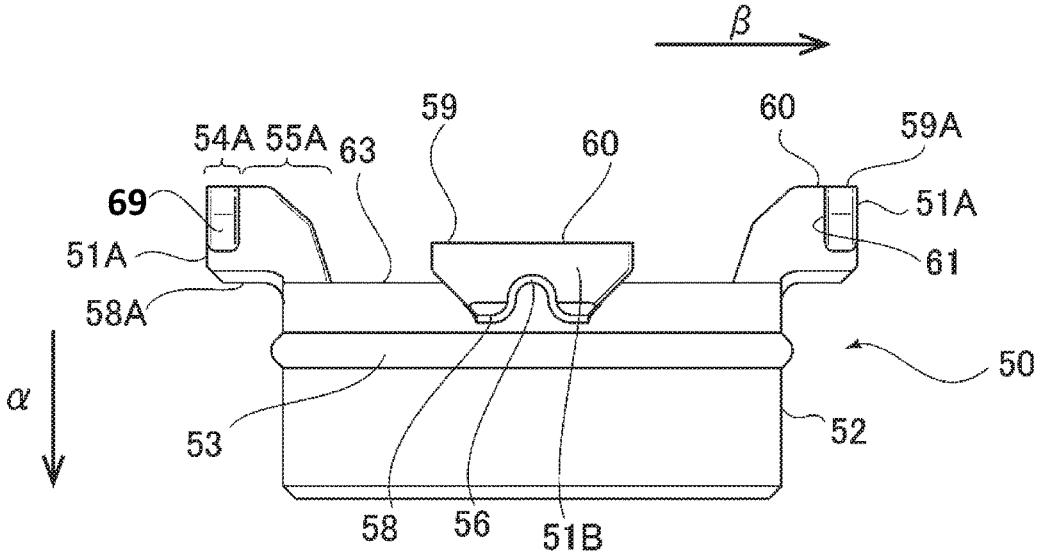
FIG. 3 is a front view showing an elastic seal member of the receptacle connector or a waterproof connector of the waterproof connector device according to the embodiment of the present invention.
Figure 4:
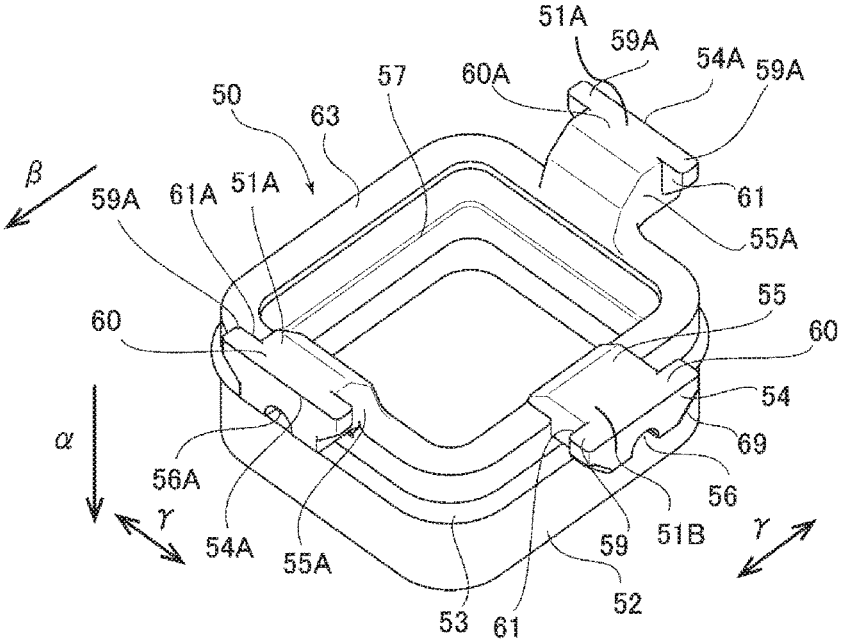
FIG. 4 is a perspective view showing the elastic seal member of the waterproof connector viewed from an upper surface thereof according to the embodiment of the present invention.
Figure 5:
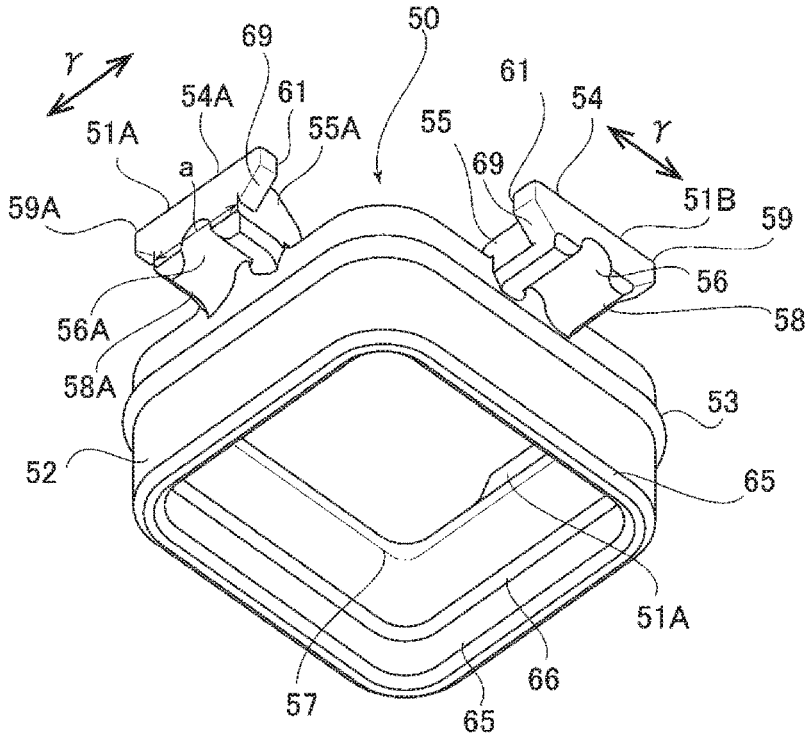
FIG. 5 is a perspective view showing the elastic seal member of the waterproof connector viewed from a bottom surface thereof according to the embodiment of the present invention.
Figure 6:
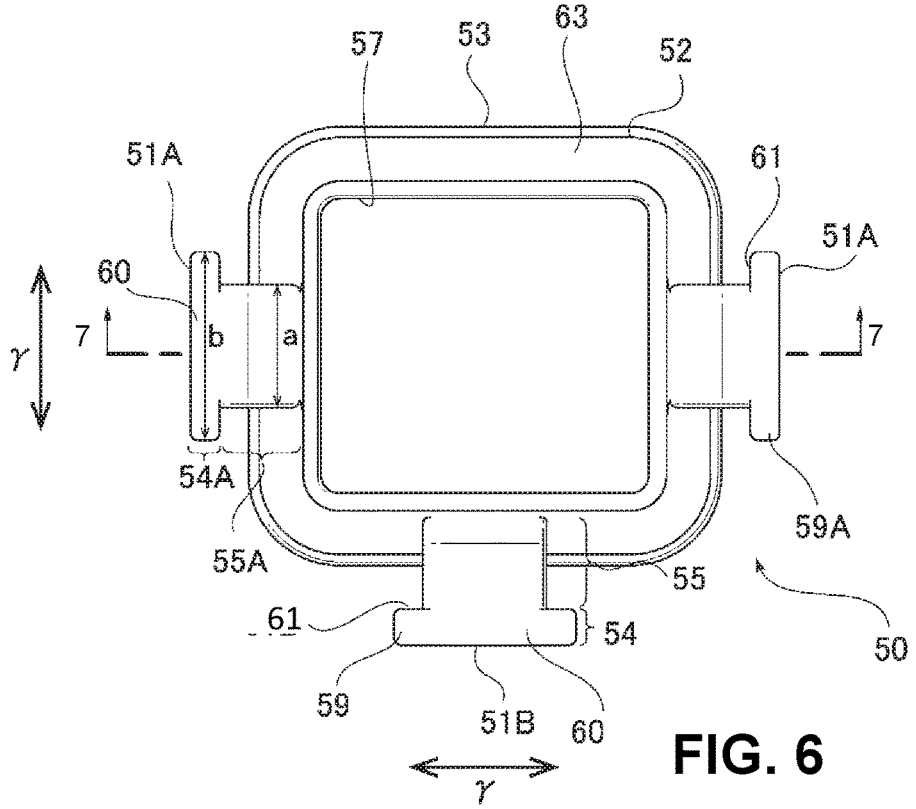
FIG. 6 is a plan view showing the elastic seal member of the waterproof connector according to the embodiment of the present invention.
Figure 7:
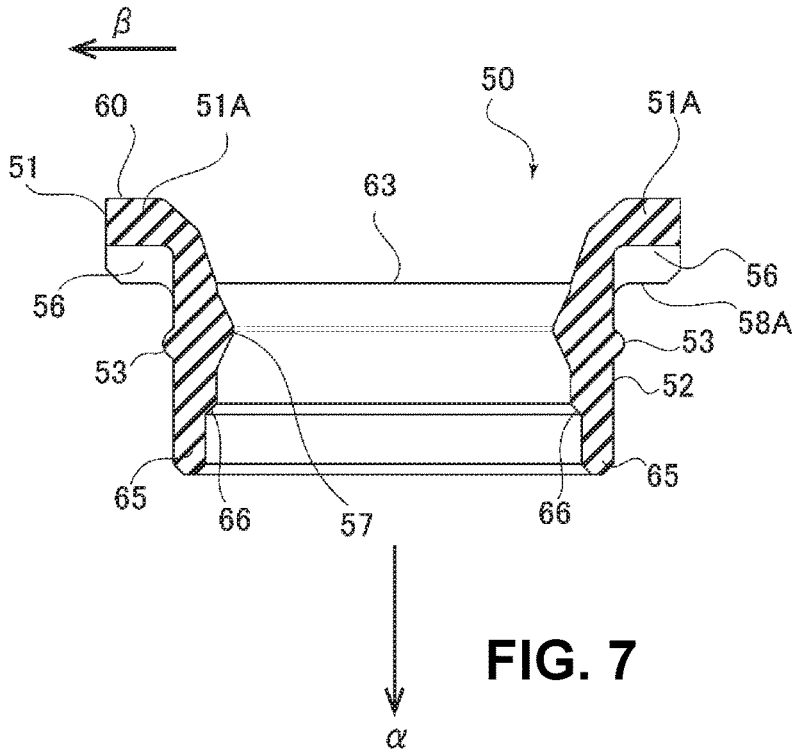
FIG. 7 is a sectional view showing the elastic seal member of the waterproof connector taken along a 7-7 line in FIG. 6 according to the embodiment of the present invention.

A configuration of the elastic seal member 50 disposed in the receptacle connector 20 will be explained next with reference to FIGS. 3 to 7. FIG. 3 is a front view showing the elastic seal member 50 of the receptacle connector 20 or the waterproof connector 20 of the waterproof connector device 1 according to the embodiment of the present invention. FIG. 4 is a perspective view showing the elastic seal member 50 of the waterproof connector 20 viewed from an upper surface thereof according to the embodiment of the present invention. FIG. 5 is a perspective view showing the elastic seal member 50 of the waterproof connector 20 viewed from a bottom surface thereof according to the embodiment of the present invention. FIG. 6 is a plan view showing the elastic seal member 50 of the waterproof connector 20 according to the embodiment of the present invention. FIG. 7 is a sectional view showing the elastic seal member 50 of the waterproof connector 20 taken along a 7-7 line in FIG. 6 according to the embodiment of the present invention.

As shown in FIGS. 3 to 7, the elastic seal member 50 is integrally formed of a material such as a rubber and a plastic. Further, the elastic seal member 50 includes a main body portion 52 to be disposed inside the hollow portion 27 for imparting a waterproof function and the engaged portions 51 (51A and 51B) to be disposed outside the hollow portion 27 for engaging the elastic seal member 50 with the housing 21.

In the embodiment, the main body portion 52 is formed in a ring shape having a substantially rectangular shape in a plane view (a short cylindrical member having a substantially rectangular sectional shape), and has a specific width in a guiding direction (an arrow direction α). The main body portion 52 includes an outer surface protrusion 53 having a ring shape on an outer circumferential surface thereof at a center in the width direction. When the main body portion 52 is accommodated in the hollow portion 27, the outer surface protrusion 53 is pressed against an inner circumferential surface of the housing 21. Accordingly, it is possible to impart the waterproof function between the inner circumferential surface of the housing 21 and the outer surface of the elastic seal member 50.

In the embodiment, the main body portion 52 further includes an inner surface protrusion 57 having a ring shape on an inner circumferential surface thereof at a location shifted from that of the outer surface protrusion 53 in the guiding direction α. When the insertion portion 71A of the plug connector 70 is inserted into the hollow portion 27 of the receptacle connector 20, the inner surface protrusion 57 is pressed and tightly contacts with an outer circumferential surface of the insertion portion 71A on a distal end side thereof. Accordingly, it is possible to impart the waterproof function between the outer surface of the plug connector 70 and the inner surface of the elastic seal member 50 (described later, refer to FIG. 10).

In the embodiment, the main body portion 52 further includes a step portion 66 on a distal end side thereof in the guiding direction α, and a fitting portion 65 with a narrow tip disposed adjacent to the step portion 66. When the main body portion 52 receives an external force in the guiding direction α, the fitting portion 65 is slightly deformed, so that the elastic seal member 50 is capable of easily moving in the guiding direction α.

In the embodiment, the main body portion 52 further includes an upper circumferential edge 63 having a substantially rectangular shape in a plane view. Three of the engaged portions 51A and 51B are disposed on the upper circumferential edge 63, in particular, three sides of the substantially rectangular shape, and extend obliquely from centers of the three sides toward an upper side. When the engaged portions 51A and 51B are disposed on the three sides of the substantially rectangular shape, as opposed to a configuration in which the engaged portions 51A and 51B are disposed on only one side or two sides of the substantially rectangular shape, it is possible to fix the elastic seal member 50 to the housing 21 in a more stable state. Further, as opposed to a configuration in which the engaged portions 51A and 51B are disposed on the four sides of the substantially rectangular shape, it is possible to prevent a size of the waterproof connector device 1 from being excessively large.

In the embodiment, all of the engaged portions 51A and 51B extend in a direction away from a radial center of the main body portion 52 (an arrow direction β). Among three of the engaged portions 51A and 51B, two of the engaged portions 51A arranged to face each other have an identical shape and an identical size. The engaged portion 51B arranged between the engaged portions 51A has a length slightly shorter than that of the engaged portions 51A. Other configurations of the engaged portion 51B are similar to those of the engaged portions 51A. In the following description, only when the engaged portions 51A and 51B need to be distinguished, the letters "A" and "B" are attached to reference numerals assigned to the engaged portions 51A and 51B and components of the engaged portions 51A and 51B.

In the embodiment, the engaged portion 51 includes a head portion 54 formed at an extending end portion thereof, and a neck portion 55 connecting the head portion 54 and the main body portion 52. The head portion 54 is formed in, for example, a substantially reverse trapezoid shape in a front view thereof. Further, the head portion 54 includes a pair of mountain portions 58 at a tapered distal end portion thereof protruding in the guiding direction α, and the mountain portions 58 are separated with a recessed portion 56 having a reverse U-character shape. It should be noted that the distal end portion formed of the mountain portions 58 and the recessed portion 56 are configured to function as a deformation portion.

In the embodiment, when the mountain portions 58 abut against a lower surface 34*b* of a cut portion 34 of the housing 21 (refer to FIGS. 1 and 2) near an installation portion 33 (refer to FIGS. 1 and 2) where the head portion 54 is accommodated in the guiding direction α, the distal end portion of the head portion 54 is deformed through the recessed portion 56 and the mountain portions 58 such that the mountain portions 58 are collapsed. Since the distal end portion of the head portion 54 is deformed, even after the engaged portion 51 abuts against the lower surface 34*b* of the cut portion 34, the engaged portion 51 is capable of moving farther in the guiding direction α.

In the embodiment, the head portion 54 further includes an upper surface 60 having a flat shape and formed on a rear end portion thereof opposite to the distal end portion (that is, an abutting end portion) in the guiding direction α. Further, the head portion 54 includes ear portions 59 protruding outwardly (an arrow direction Y or a protruding direction Y) farther than the mountain portions 58. Accordingly, tapered portions 69 are formed from the distal end portion of the head portion 54 toward the opposite side to the distal end portion in the guiding direction α. It should be noted that the head portion 54 without the ear portion 59 has a width "a" in the protruding direction Y equal to a width "a" of the neck portion 55 in the protruding direction Y (refer to FIG. 6).

An inner structure of the housing 21 of the receptacle connector 20 at the accommodation portion 21A thereof, and an operation of inserting the elastic seal member 50 and the plug connector 70 into the accommodation portion 21A will be explained next with reference to FIGS. 8 to 10.

Figure 8:
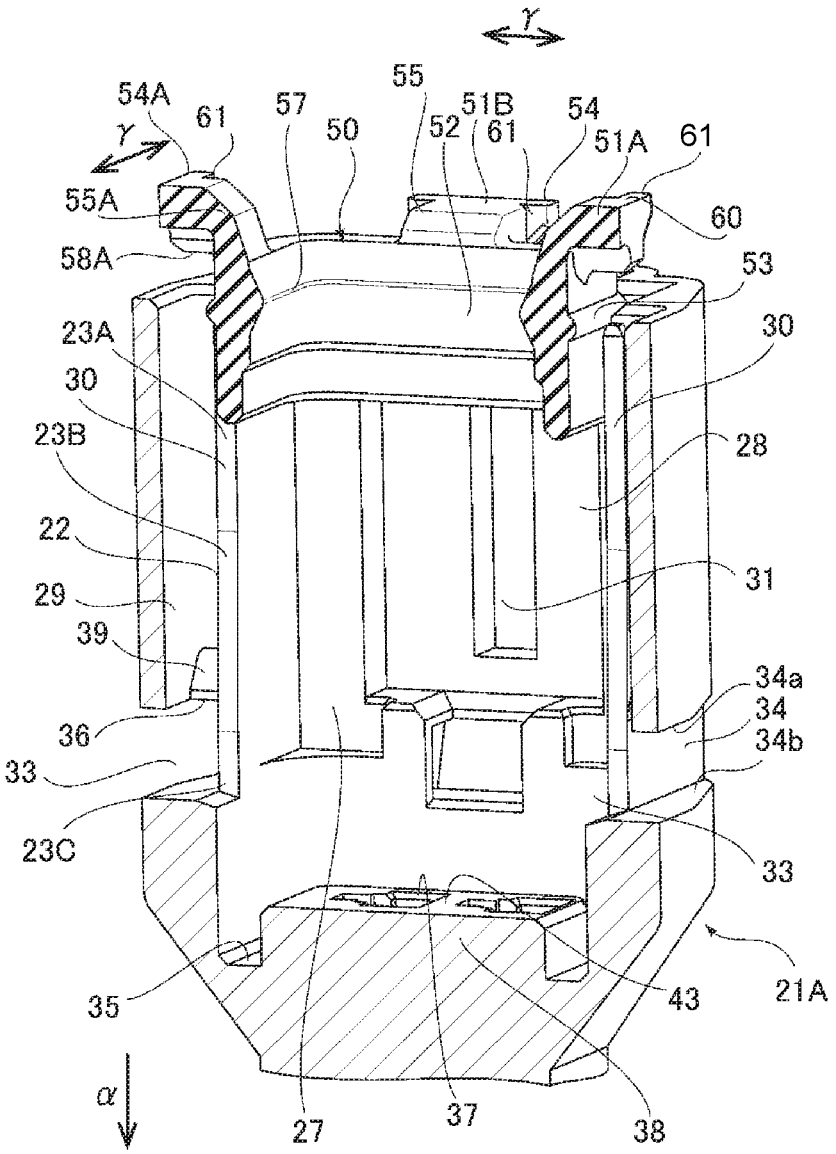
FIG. 8 is a sectional view No. 1 showing an inner structure of a housing of the receptacle connector when the elastic seal member thereof is situated at an entrance of a hollow portion of the housing according to the embodiment of the present invention.
Figure 9:
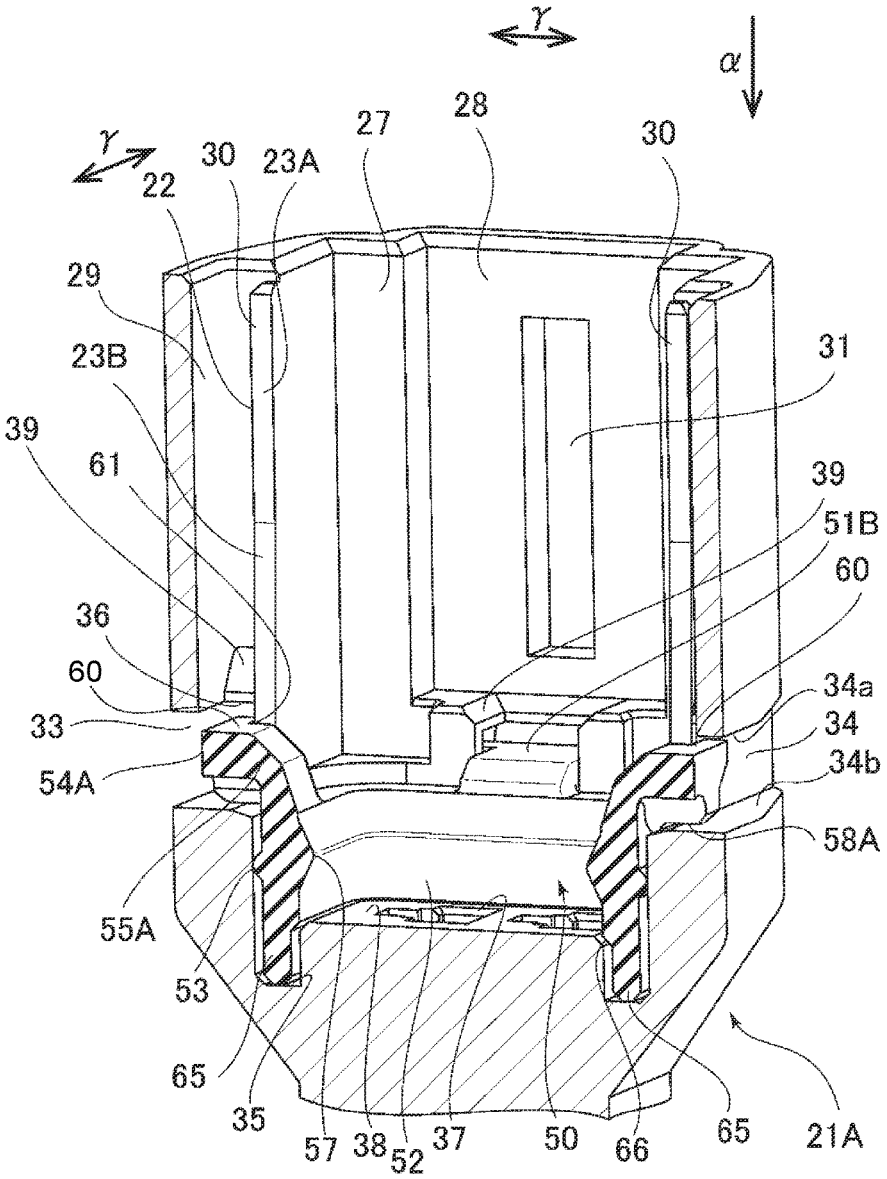
FIG. 9 is a sectional view No. 2 showing the inner structure of the housing of the receptacle connector when the elastic seal member thereof is placed at a specific location in the hollow portion of the housing according to the embodiment of the present invention.

FIG. 8 is a sectional view No. 1 showing the inner structure of the housing 21 of the receptacle connector 20 when the elastic seal member 50 thereof is situated at an entrance of the hollow portion 27 of the housing 21 according to the embodiment of the present invention. FIG. 9 is a sectional view No. 2 showing the inner structure of the housing 21 of the receptacle connector 20 when the elastic seal member 50 thereof is placed at a specific location in the hollow portion 27 of the housing 21 after the elastic seal member 50 is guided along the hollow portion 27 in the guiding direction α according to the embodiment of the present invention. FIG. 10 is a sectional view No. 3 showing the inner structure of the housing 21 of the receptacle connector 20 when the insertion portion 71A of the plug connector 70 is inserted into the hollow portion 27 of the housing 21 after the elastic seal member 50 is placed at the specific location according to the embodiment of the present invention.

In the embodiment, in the state that the main body portion 52, in particular the outer surface protrusion 53, of the elastic seal member 50 is tightly pressed against the inner surface of the hollow portion 27, the elastic seal member 50 is guided along the guiding direction α. While the elastic seal member 50 is guided, the head portions 54 remain inside the housing 21. Once the elastic seal member 50 is completely placed at the specific location (the installation portions 33), the head portions 54 are exposed externally.

In the embodiment, guide grooves 23 are formed in the hollow portion 27 along the guiding direction α for guiding the engaged portions 51A of the elastic seal member 50. The guide grooves 23 may be formed of, for example, guide ribs 30. Accordingly, in a state that the guide grooves 23 sandwich the neck portions 55A connecting the head portions 54A and the main body portions 52A, the elastic seal member 50 is guided at the locations situated at symmetrical positions in the left-to-right direction.

With the configuration described above, it is possible to easily guide the engaged portions 51A to the specific locations in the housing 21. Further, it is possible to securely fix the elastic seal member 50 at the specific locations. It should be noted that the hollow portion 27 is not provided with a guide groove for guiding the engaged portion 51B. However, since the engaged portions 51A is guided in a stable manner, it is possible to stably guide the engaged portion 51B as a result. Alternatively, the hollow portion 27 may be not provided with a guide groove for guiding the engaged portion 51B.

As shown in FIG. 8, the housing 21 of the receptacle connector 20 includes a regulating step portion 38, and a groove 35 is formed around the regulating step portion 38. Further, the regulating step portion 38 has an abutting surface 43. As shown in FIGS. 9 and 10, when the elastic seal member 50 is guided along the hollow portion 27 in the guiding direction α, and the elastic seal member 50 is placed at the specific location in the housing 21, the fitting portion 65 disposed on the main body portion 52 of the elastic seal member 50 is fitted into the groove 35 formed around the regulating step portion 38 of the housing 21. Accordingly, it is possible to securely position the main body portion 52 at the specific location in the housing 21.

Figure 10:
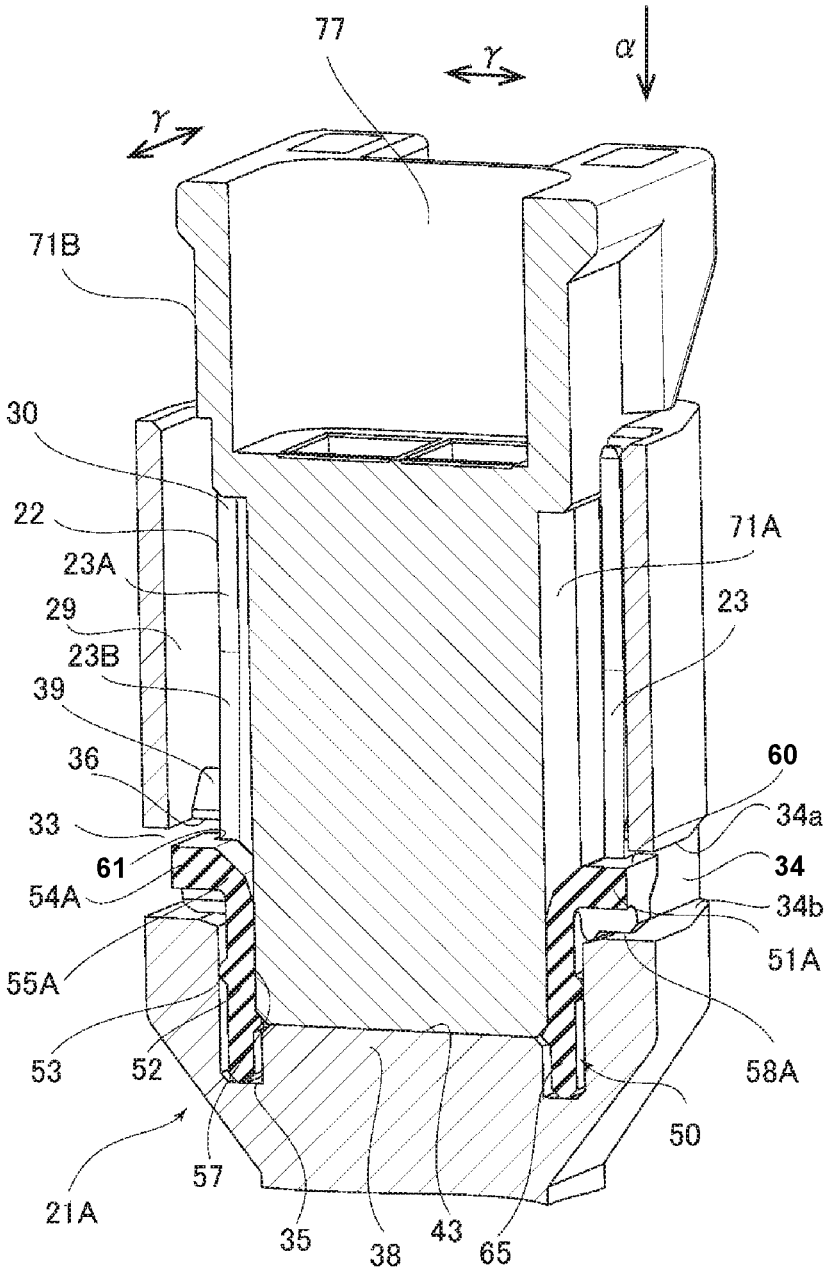
FIG. 10 is a sectional view No. 3 showing the inner structure of the housing of the receptacle connector when the plug connector is inserted into the hollow portion of the housing according to the embodiment of the present invention.

As shown in FIG. 10, when the insertion portion 71A of the plug connector 70 is inserted into the hollow portion 27 of the housing 21, a front surface of the insertion portion 71A abuts against the abutting surface 43 of the regulating step portion 38, so that the plug connector 70 is restricted to move farther. At this moment, the inner surface protrusion 57 of the main body portion 52 is tightly contacted with the outer circumferential surface of the insertion portion 71A of the plug connector 70. Accordingly, it is possible to attain waterproof between the elastic seal member 50 and the plug connector 70. At the same time, the contacts (not shown) of the receptacle connector 20 are contacted with the contacts (not shown) of the plug connector 70 near the abutting surface 43 of the regulating step portion 38. Further, the housing 21 of the receptacle connector 20 includes lances 42 accommodated in holes 37 formed in the abutting surface 43 of the regulating step portion 38 (refer to FIG. 11), so that the contacts (not shown) of the receptacle connector 20 are maintained securely in the contact state with the contacts (not shown) of the plug connector 70.

Figure 12:
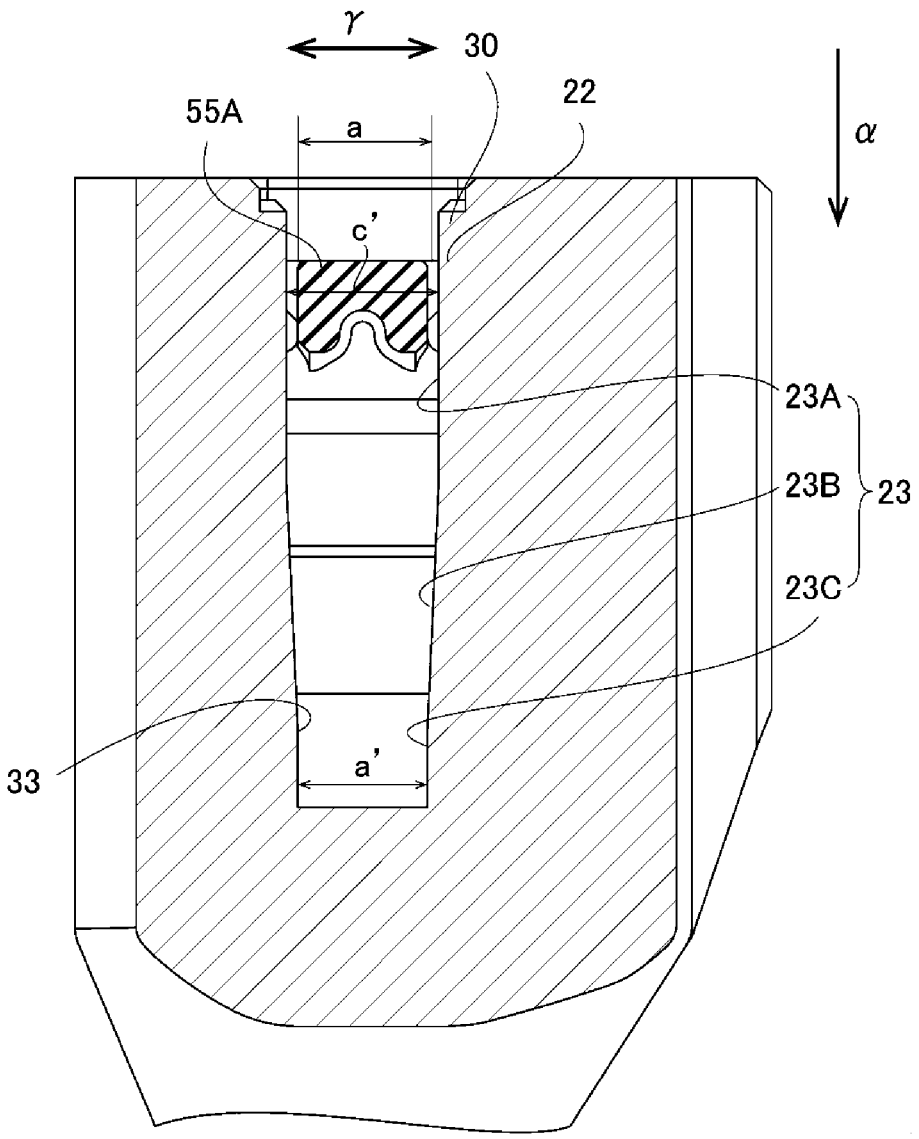
FIG. 12 is a sectional view No. 1 showing the receptacle connector taken along a line 12-12 in FIG. 11 when the elastic seal member thereof is situated at an entrance of a hollow portion of a housing thereof according to the embodiment of the present invention.
Figure 13:
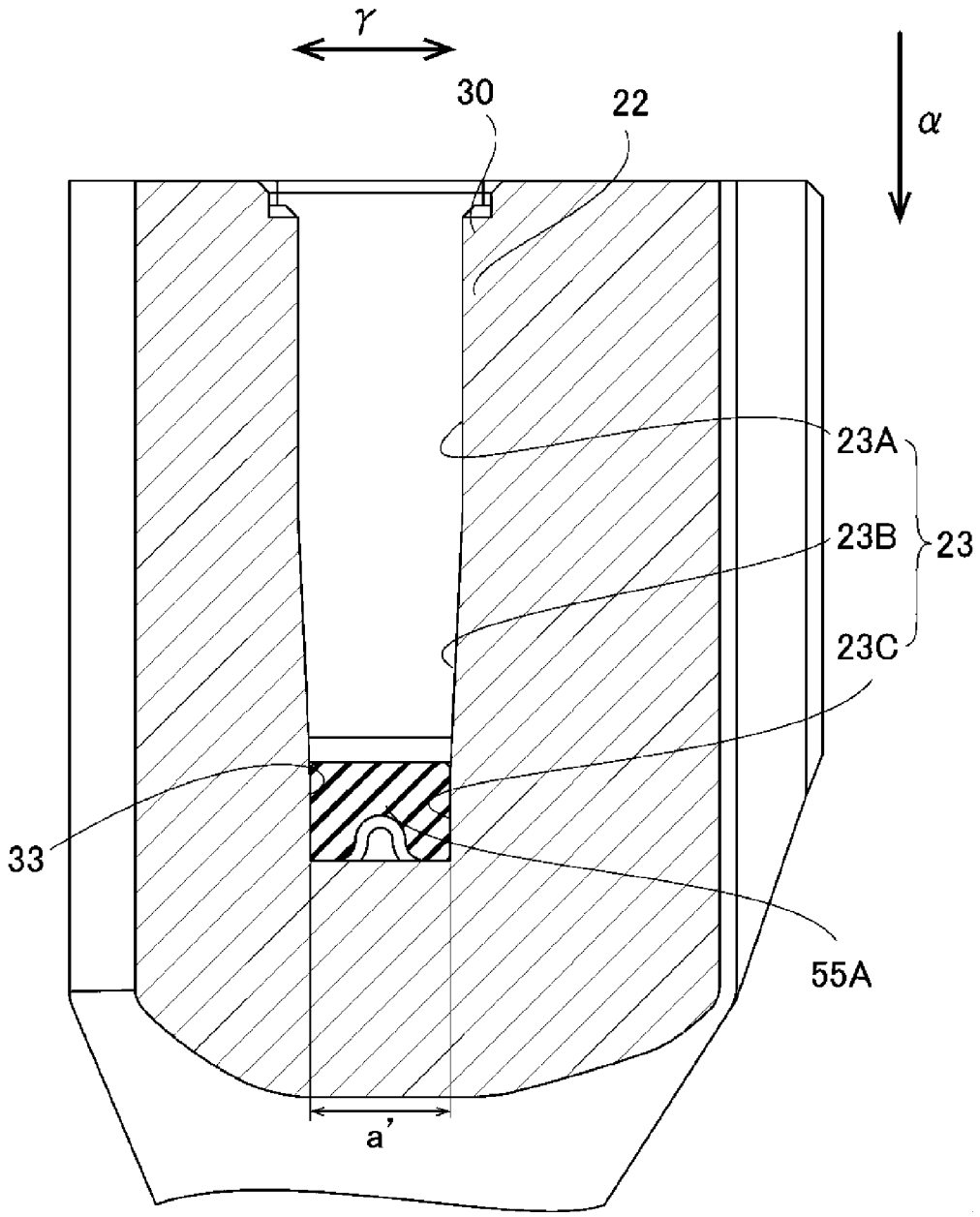
FIG. 13 is a sectional view No. 2 showing the receptacle connector taken along the line 12-12 in FIG. 11 when the elastic seal member thereof is situated at a specific location in the housing after the elastic seal member is guided through the hollow portion of the housing thereof according to the embodiment of the present invention.

A movement of the head portions 54 of the elastic seal member 50 when the elastic seal member 50 is guided along the hollow portion 27 of the housing 21 will be explained next with reference to FIGS. 11 to 13.

Figure 11:
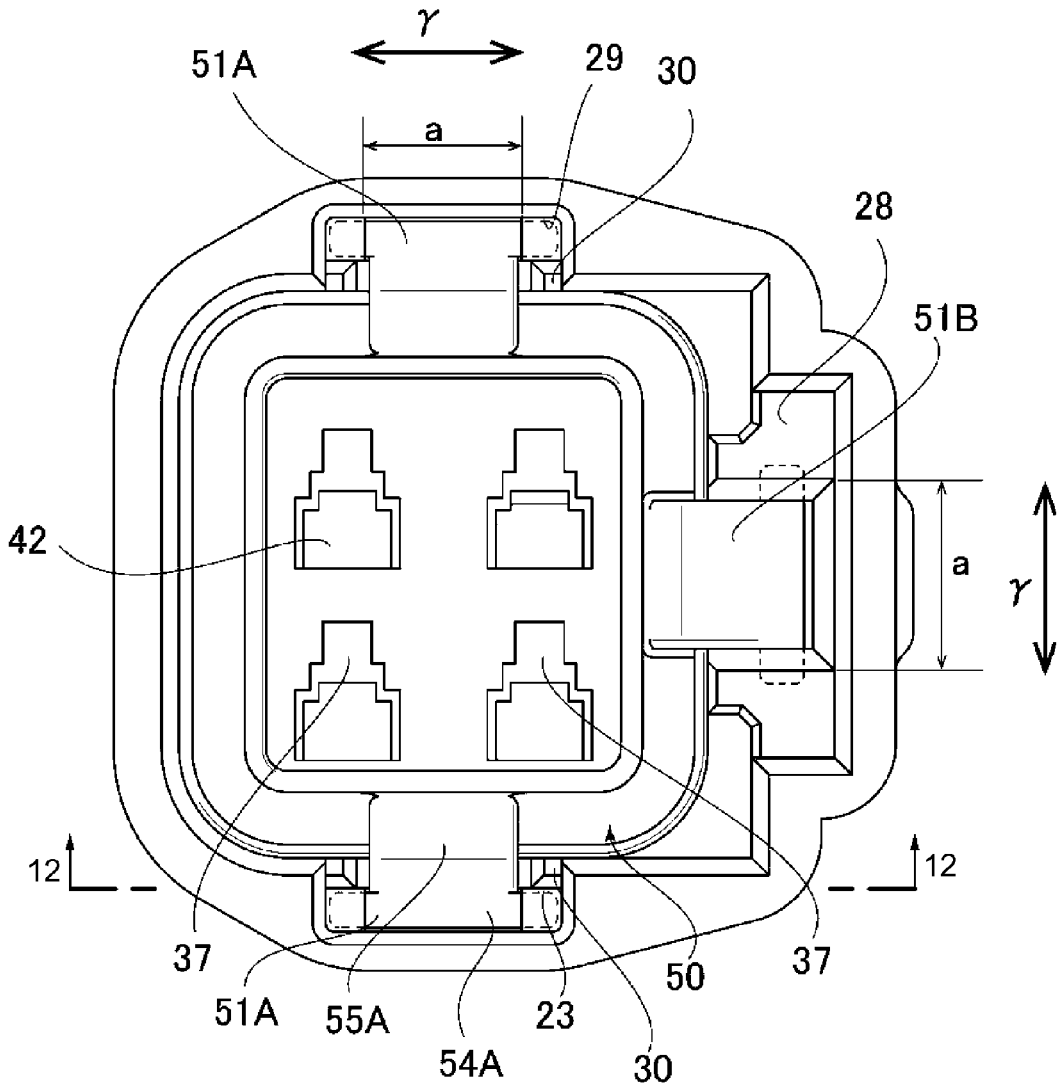
FIG. 11 is a plan view No. 1 showing the receptacle connector viewed in a guiding direction according to the embodiment of the present invention.

FIG. 11 is a plan view No. 1 showing the receptacle connector 20 viewed in the guiding direction α according to the embodiment of the present invention. FIG. 12 is a sectional view No. 1 showing the receptacle connector 20 taken along a line 12-12 in FIG. 11 when the elastic seal member 50 thereof is situated at an entrance of the hollow portion 27 of the housing 21 thereof according to the embodiment of the present invention. FIG. 13 is a sectional view No. 2 showing the receptacle connector 20 taken along the line 12-12 in FIG. 11 when the elastic seal member 50 thereof is placed at the specific location in the housing 21 after the elastic seal member 50 is guided through the hollow portion 27 of the housing 21 thereof according to the embodiment of the present invention. It should be noted that the elastic seal member 50 shown in FIG. 11 is placed at the specific location shown in FIG. 13, that is, the elastic seal member 50 is completely attached to the hollow portion 27 of the receptacle connector 20.

As described above, in the embodiment, the guide groove 23 sandwiches the head portion 54A of the engaged portion 51A. As shown in FIG. 12, a width of the guide groove 23 in the protruding direction Y is formed to decrease along the guiding direction α. With the configuration, when the elastic seal member 50 is guided along the guide groove 23, the guide groove 23 is gradually tightening the head portion 54A of the engaged portion 51A of the elastic seal member 50. Accordingly, it is possible to easily and securely fix the elastic seal member 50.

More specifically, in order to design the width of the guide groove 23, the guide groove 23 includes a wide width portion 23A near the entrance of the hollow portion 27, a narrow width portion 23C near a farthermost backside of the hollow portion 27, and a tapered portion 23B between the wide width portion 23A and the narrow width portion 23C.

The wide width portion 23A has a width "c'" in the protruding direction Y, and the narrow width portion 23C has a width "a'" in the protruding direction Y. The head portion 55A of the engaged portion 51A has the width "a" in the protruding direction Y near the entrance of the hollow portion 27, and the width "a" is smaller than the width "c'" and larger than the width "b'" near the installation portion 33 where the engaged portion 51A is placed. Accordingly, it is possible to smoothly insert the elastic seal member 50 near the entrance of the guide groove 23, and to securely fix the elastic seal member 50 at the specific location.

As described above, in the embodiment, the width of the guide groove 23 in the protruding direction Y is formed to decrease along the guiding direction α. With the configuration, the ear portion 59 of the head portion 54 abuts against an outer surface 22 of the guide rib 30 forming the guide groove 23 at a backside surface 61 thereof. Accordingly, it is possible to prevent the elastic seal member 50 from falling down into the hollow portion 27 of the housing 21.

In the embodiment, when the neck portion 55 is moved, the head portion 54 is also moved in the guiding direction α. A function of the head portion 54 when the elastic seal member 50 is guided along the hollow portion 27 of the housing 21 will be explained next with reference to FIGS. 14 to 18.

Figure 14:
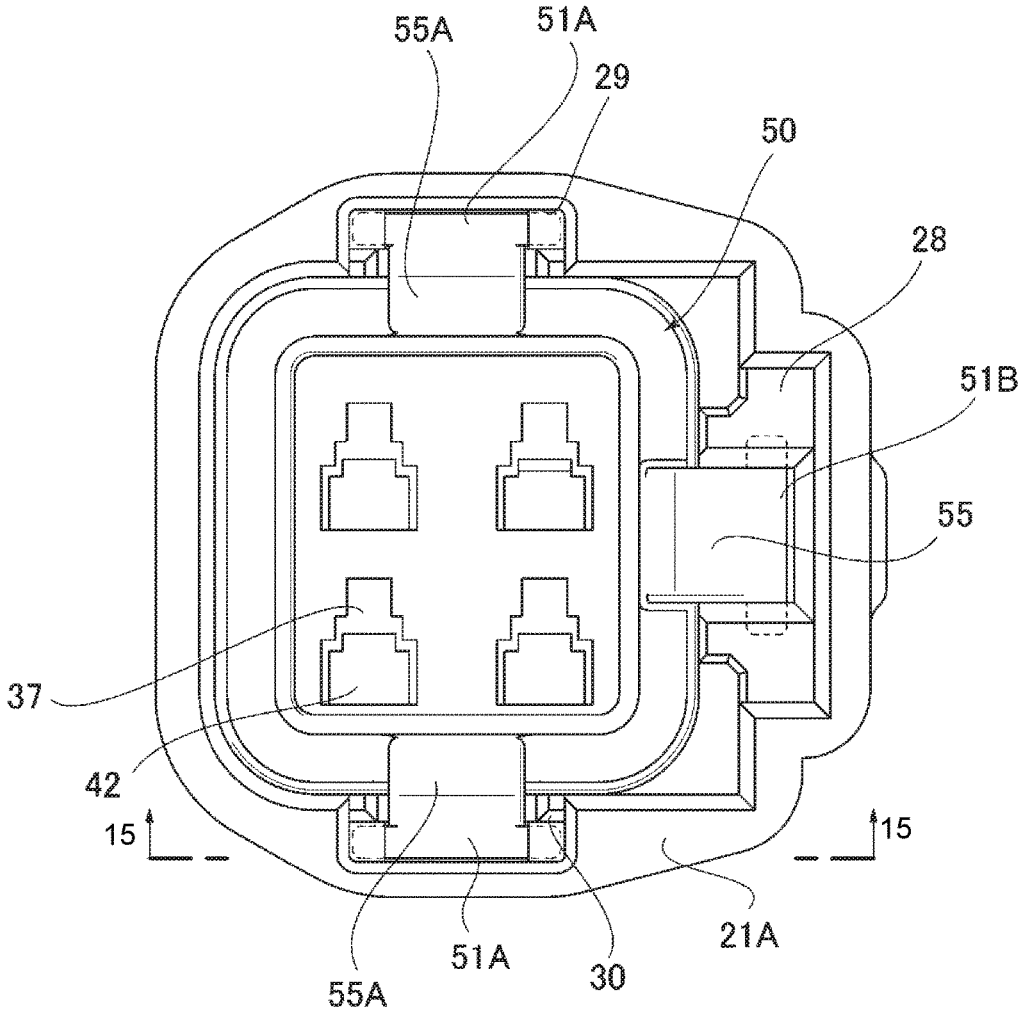
FIG. 14 is a plan view No 2 showing the receptacle connector viewed in the guiding direction according to the embodiment of the present invention.

FIG. 14 is a plan view No 2 showing the receptacle connector 20 viewed in the guiding direction α according to the embodiment of the present invention. It should be noted that the elastic seal member 50 shown in FIG. 14 is placed at the specific location shown in FIG. 18, that is, the elastic seal member 50 is completely attached to the hollow portion 27 of the receptacle connector 20.

Figure 15:
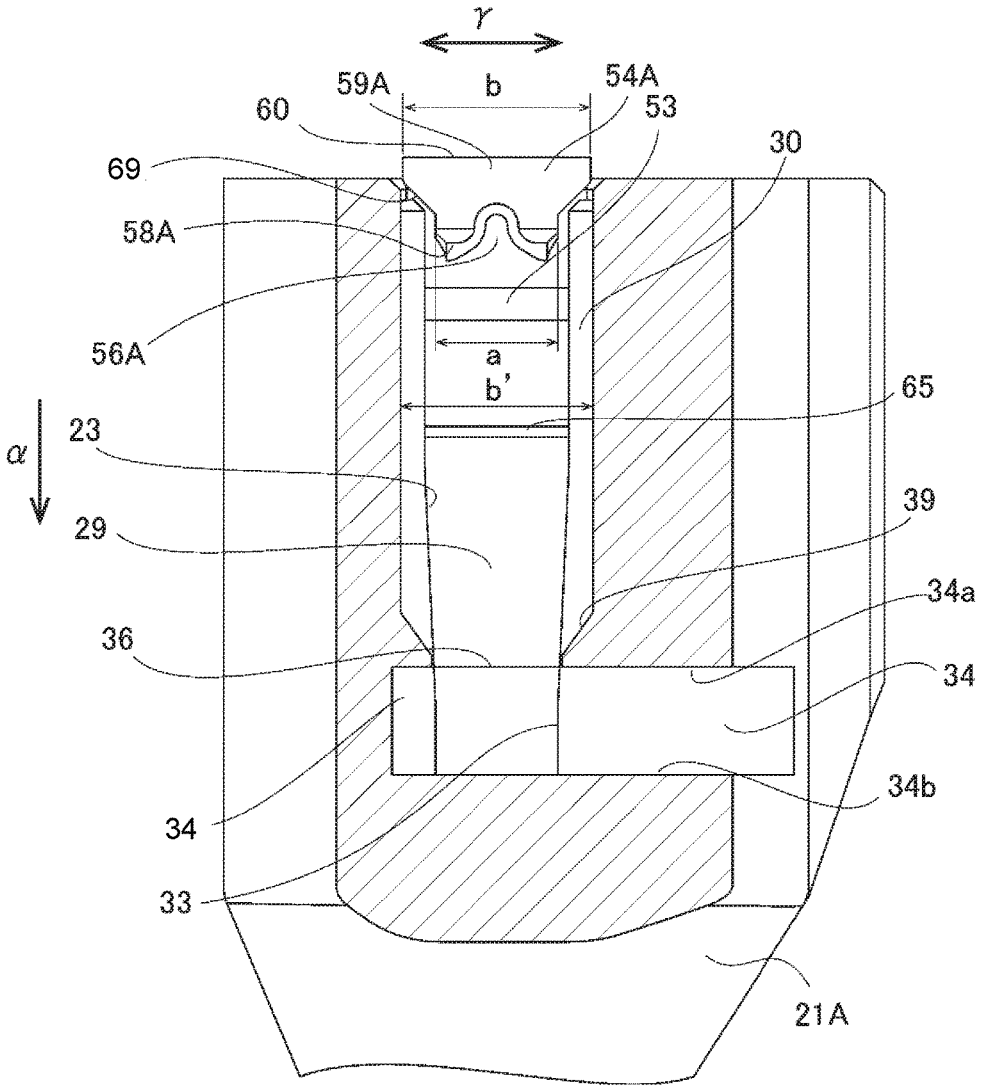
FIG. 15 is a sectional view No. 1 showing the receptacle connector taken along a line 15-15 in FIG. 14 when the elastic seal member thereof is situated at the entrance of the hollow portion of the housing thereof according to the embodiment of the present invention.

FIG. 15 is a sectional view No. 1 showing the receptacle connector 20 taken along a line 15-15 in FIG. 14 when the elastic seal member 50 thereof is situated at the entrance of the hollow portion 27 of the housing 21 thereof according to the embodiment of the present invention.

As shown in FIG. 15, the housing 21 has a width "b'" in the protruding direction Y at a corresponding location, and the width "b'" is configured to be slightly larger than a width "b" of the head portion 54A including the ear portions 59A in the protruding direction Y. Accordingly, it is possible to smoothly insert the head portion 54A into the housing 21 at the entrance of the hollow portion 27.

Figure 16:
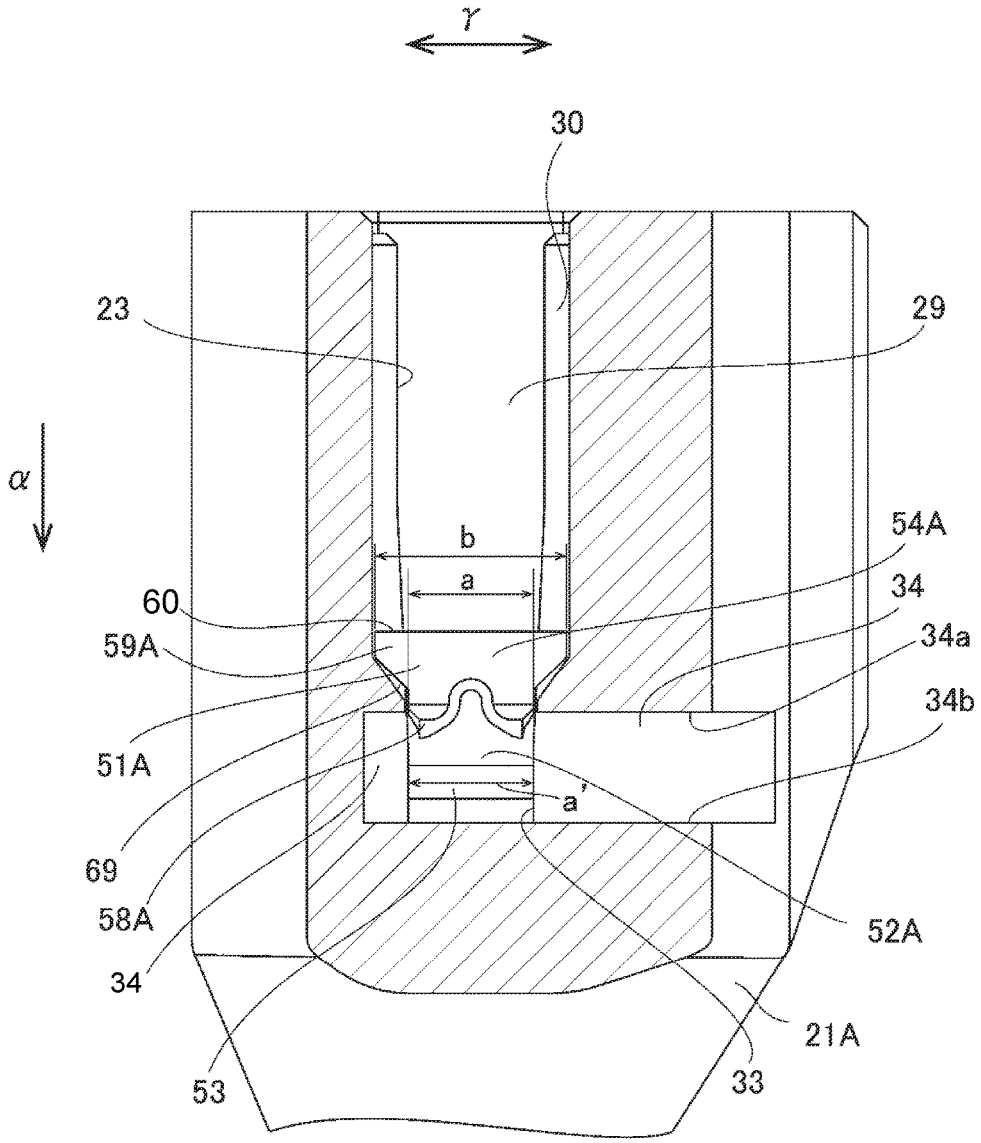
FIG. 16 is a sectional view No. 2 showing the receptacle connector taken along the line 15-15 in FIG. 14 when the elastic seal member thereof is guided through the hollow portion of the housing thereof according to the embodiment of the present invention.

FIG. 16 is a sectional view No. 2 showing the receptacle connector 20 taken along the line 15-15 in FIG. 14 when the elastic seal member 50 thereof is guided through the hollow portion 27 of the housing 21 thereof according to the embodiment of the present invention.

As shown in FIG. 16, when the head portion 54A is inserted into the housing 21 to some extent, the ear portions 59A protruding from the head portion 54A contact with the regulating step portion 39 near the tapered portion 69 situated at the lower portion of the ear portions 59A. Accordingly, it is possible to prevent the engaged portion 51A from moving in the guiding direction α.

Further, in the embodiment, the deformation portion (the recessed portion 56A and the mountain portion 58A) of the head portion 54A has the width "a" in the protruding direction Y, and the width "a" is larger than the width "a" of an installation portion entrance 36 of the housing 21 in the protruding direction Y. Accordingly, it is possible to smoothly insert a part of the distal end portion of the head portion 54A. Further, unless an external force is applied to the elastic seal member 50, a whole portion of the head portion 54A including the ear portions 59A does not pass through the installation portion entrance 36. In this case, when a tool and the like is used to move the elastic seal member 50 farther in the guiding direction α, the ear portions 59A are deformed, so that the head portion 54A can pass through the installation portion entrance 36.

Figure 17:
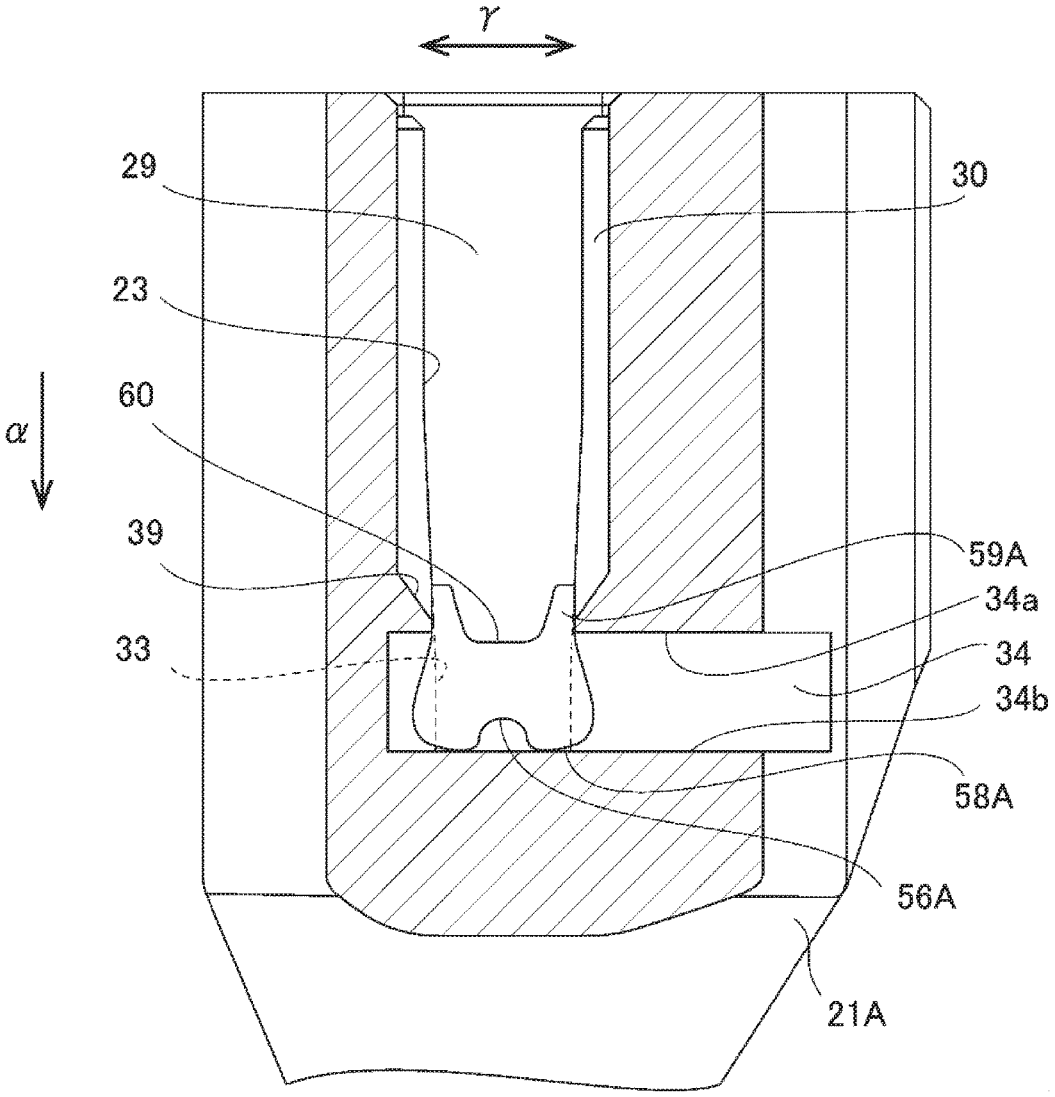
FIG. 17 is a sectional view No. 3 showing the receptacle connector taken along the line 15-15 in FIG. 14 when the elastic seal member thereof is guided through the hollow portion of the housing thereof according to the embodiment of the present invention.

FIG. 17 is a sectional view No. 3 showing the receptacle connector 20 taken along the line 15-15 in FIG. 14 when the elastic seal member 50 thereof is guided through the hollow portion 27 of the housing 21 thereof according to the embodiment of the present invention. More specifically, FIG. 17 shows a state in the middle of a process that the head portion 54A passes through the installation portion entrance 36.

As shown in FIG. 17, at this moment, the deformation portion (the recessed portion 56A and the mountain portions 58A) disposed at the distal end portion of the head portion 54A abuts against the lower surface 34*b* of the cut portion 34 of the housing 21 in the guiding direction α (refer to FIGS. 1 and 2). As a result, the mountain portions of the deformation portion are deformed in a direction away from each other, so that the engaged portion 51A can move farther in the guiding direction α.

In the embodiment, when the elastic seal member 50 moves farther in the guiding direction α, the ear portions 59A abut against the regulating step portion 39 of the housing 21 and the installation portion entrance 36, so that the ear portions 59A are lifted upwardly. Accordingly, the engaged portion 51A can pass through the installation portion entrance 36.

Figure 18:
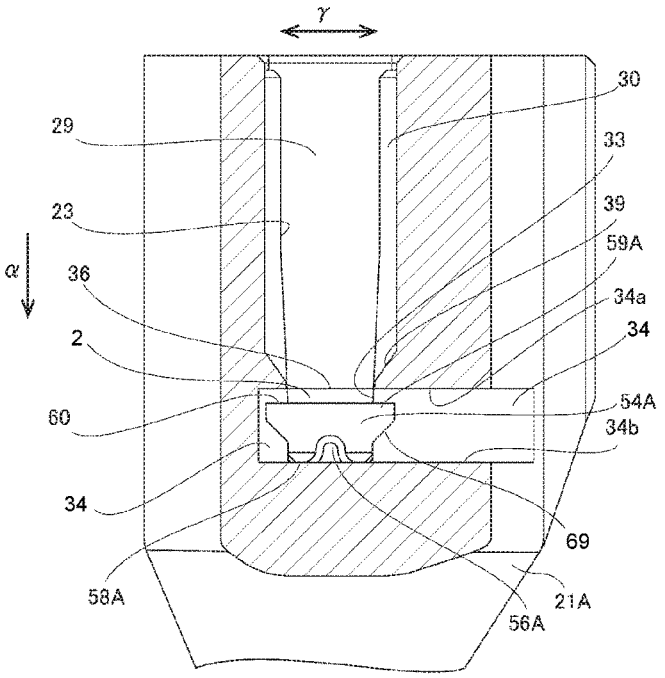
FIG. 18 is a sectional view No. 4 showing the receptacle connector taken along the line 15-15 in FIG. 14 when the elastic seal member thereof is placed at the specific location in the hollow portion of the housing thereof according to the embodiment of the present invention.
Figure 19:
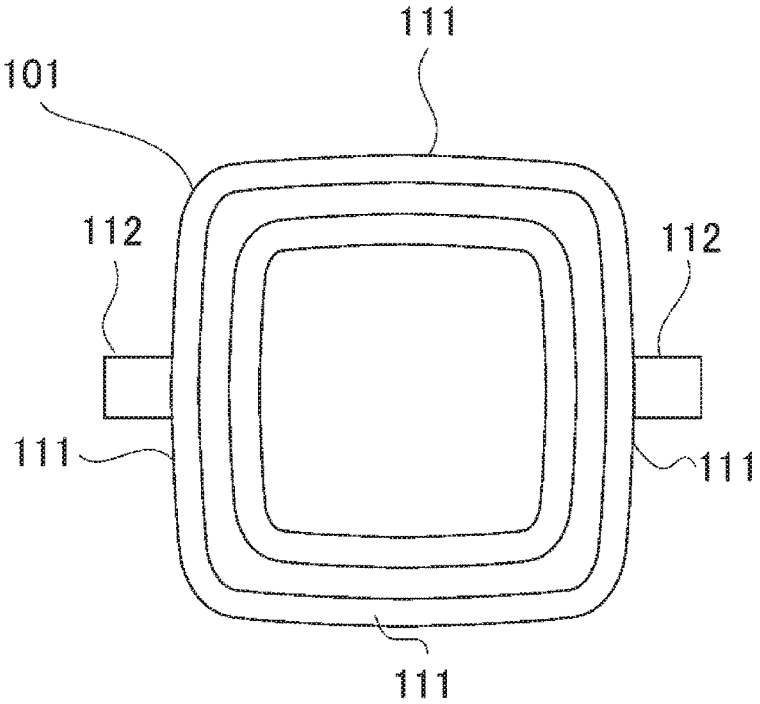
FIG. 19 Prior Art
FIG. 19 is a plan view showing a conventional waterproof connector having an elastic seal member according to Patent Reference.
Figure 20:
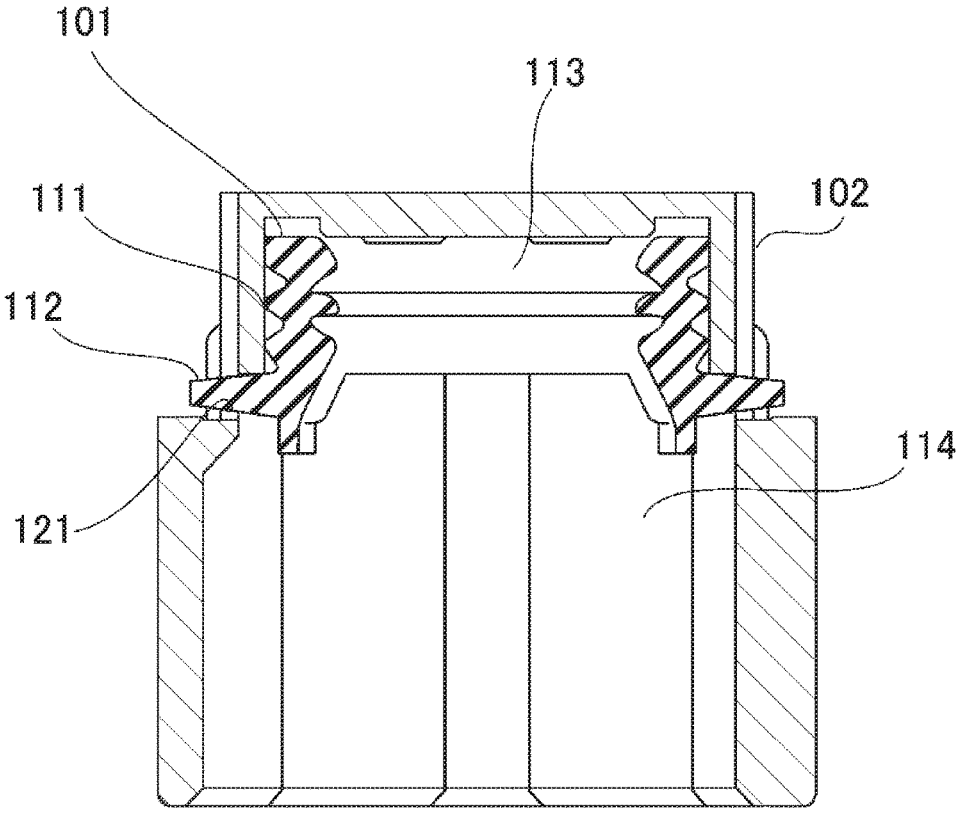
FIG. 20 Prior Art
FIG. 20 is a sectional view showing the conventional waterproof connector when the elastic seal member is attached to a housing of the conventional waterproof connector according to Patent Reference.

FIG. 18 is a sectional view No. 4 showing the receptacle connector 20 taken along the line 15-15 in FIG. 14 when the elastic seal member 50 thereof is placed at the specific location in the hollow portion 27 of the housing 21 thereof according to the embodiment of the present invention. More specifically, FIG. 18 shows a state that the ear portions 59A completely passes through the installation portion entrance 36, and the ear portions 59A are returned to an original state before the deformation.

As shown in FIG. 18, at this moment, the ear portions 59A abut against an upper surface 34*a* of the housing 21 opposite to the lower surface 34*b* of the housing 21. Accordingly, the engaged portion 51A does not easily come off the installation portion 33.

In the embodiment, the upper surface 34*a* and the lower surface 34*b* are arranged to abut against the specific portions of the engaged portion 51A, and the upper surface 34*a* and the lower surface 34*b* are formed with the cut portion 34 as a part of the housing 21 being cut in the lateral direction as a whole. Alternatively, it is suffice to form the abutting portions, and it is not necessary to form the abutting portion with the cut portion 34.

Further, in the embodiment, a clearance 2 is formed between the upper surface 60 of the head portion 54A and the installation portion 33, so that the ear portions 59A are pushed into the installation portion 33. Alternatively, it is possible to remove the clearance 2 depending on the size of the ear portions 59A or a deformation amount of the deformation portion.

It should be noted that the present invention is not limited to the embodiment described above, and may be capable of being modified in various forms. For example, in the embodiment, the head portion 54 is formed in the substantially reverse trapezoid shape in the front view thereof. It should be noted that, as long as the head portion 54 is formed in a shape capable of obtaining the specific function, and may be formed in an arbitrary shape.

According to the present invention, it is possible to widely apply the configuration described above to the waterproof connector having the elastic seal member necessary to be engaged with the housing thereof.

The present invention is applicable in various waterproof connectors, in which a wiring board and a plate conductive member are electrically connected while holding the plate conductive member upright on a planar surface of the wiring board.

The disclosure of Japanese Patent Applications No. 2014-124315, filed on Jun. 17, 2014, is incorporated in the application by reference.

While the present invention has been explained with reference to the specific embodiments of the present invention, the explanation is illustrative and the present invention is limited only by the appended claims.

What is claimed is:

1. A waterproof connector to be connected to a mating connector, comprising:

a housing including a hollow portion for accommodating the mating connector; and an elastic seal member disposed in the housing, wherein said elastic seal member includes a main body portion and an engaged portion extending from the main body portion, said housing further includes a guide groove formed in an inner surface thereof inside the hollow portion for guiding the elastic seal member, said guide groove has a width gradually decreasing, said engaged portion includes a neck portion and a protruding portion at a distal end of the neck portion, said housing includes an installation portion for accommodating the neck portion of the engaged portion, and said protruding portion has a width greater than a width of the installation portion so that the engaged portion abuts against the installation portion and is deformed when the elastic seal member is inserted into the hollow portion.

2. The waterproof connector according to claim 1, wherein said engaged portion includes a deformation portion configured to be deformed when the engaged portion abuts against the housing so that the elastic seal member is inserted into the hollow portion.

3. The waterproof connector according to claim 2, wherein said deformation portion includes a pair of mountain portions and a recessed portion between the mountain portions, and said mountain portions are deformed away from each other when the engaged portion abuts against the housing.

4. The waterproof connector according to claim 1, wherein said protruding portion is configured to return to an original shape thereof when the engaged portion is accommodated in the installation portion after the elastic seal member is inserted into the hollow portion.

5. The waterproof connector according to claim 1, wherein said protruding portion has the width smaller than the width of the guide groove at an entrance of the guide groove, and equal to or greater than the width of the guide groove at a backside of the guide groove.

6. The waterproof connector according to claim 1, wherein said protruding portion is formed in a substantially reverse trapezoid shape in a front view thereof.

7. The waterproof connector according to claim 1, wherein said main body portion is formed in a substantially rectangular shape in a front view thereof, and said engaged portion is disposed at a center of a side of the substantially rectangular shape.

8. The waterproof connector according to claim 7, wherein said engaged portion is disposed on each of three sides of the substantially rectangular shape.

9. A waterproof connector device comprising the waterproof connector according to claim 1 and the mating connector.

* * * * *